US008251880B2

(12) United States Patent
Hampton

(10) Patent No.: US 8,251,880 B2
(45) Date of Patent: Aug. 28, 2012

(54) HAMSTRING STRETCHING DEVICE

(76) Inventor: George Hampton, San Diego, CA (US)

( * ) Notice: Subject to any disclaimer, the term of this patent is extended or adjusted under 35 U.S.C. 154(b) by 273 days.

(21) Appl. No.: 12/756,819

(22) Filed: Apr. 8, 2010

(65) Prior Publication Data

US 2010/0261589 A1 Oct. 14, 2010

Related U.S. Application Data

(60) Provisional application No. 61/168,537, filed on Apr. 10, 2009, provisional application No. 61/222,850, filed on Jul. 2, 2009.

(51) Int. Cl.
*A61H 1/02* (2006.01)
*A63B 21/002* (2006.01)

(52) U.S. Cl. ..... 482/131; 482/91; 482/907; 601/35; 606/241

(58) Field of Classification Search ..... 482/50, 482/79, 91, 131, 907; 601/35; 606/241
See application file for complete search history.

(56) References Cited

U.S. PATENT DOCUMENTS 4,926,722 A * 5/1990 Sorensen et al. ..... 81/487
5,108,090 A 4/1992 Reed
6,210,348 B1 * 4/2001 Reed ..... 601/23
6,352,495 B1 * 3/2002 Hsu ..... 482/92
6,367,787 B1 * 4/2002 Poole et al. ..... 269/6
6,634,995 B1 10/2003 Reed
6,656,094 B2 * 12/2003 Rigas ..... 482/131
7,981,015 B2 * 7/2011 Reed ..... 482/131
8,092,354 B2 * 1/2012 Oller, Jr. ..... 482/131
2003/0114280 A1 * 6/2003 Rigas ..... 482/123
2005/0096193 A1 * 5/2005 Brun ..... 482/91
2011/0190096 A1 * 8/2011 Clarke ..... 482/4
2012/0015784 A1 * 1/2012 Reed ..... 482/131

OTHER PUBLICATIONS

Notification, International Search Report and Written Opinion for PCT/US2010/030508 dated Nov. 17, 2010.

* cited by examiner

*Primary Examiner* — Loan Thanh
*Assistant Examiner* — Victor K Hwang
(74) *Attorney, Agent, or Firm* — Procopio, Cory, Hargreaves & Savitch LLP

(57) ABSTRACT

An apparatus that facilitates the stretching and exercising of the hamstring and back muscles is provided. The apparatus can be used for stretching to improve flexibility, to warm up muscles before physical activity, and/or for physical rehabilitation after injury. The apparatus includes a set of hand grips and a set of foot plates. A user grasps the hand grips and positions the arches of his or her feet above the foot plates. The apparatus includes a user actuated drive mechanism for moving a set of hand grips along the shaft toward the foot plates. The user maintains a grip of the hand grips as the hand grips move along the shaft toward the foot plates, thereby stretching the hamstring and back muscles of the user.

14 Claims, 8 Drawing Sheets

HAMSTRING STRETCHING DEVICE

RELATED APPLICATIONS

This application claims the benefit of U.S. Provisional Patent Application Ser. No. 61/168,537, filed Apr. 10, 2009, entitled "HAMSTRING STRETCHING DEVICE," and U.S. Provisional Patent Application No. 61/222,850, filed Jul. 2, 2009, entitled "HAMSTRING STRETCHING DEVICE" which are hereby incorporated by reference in their entirety.

FIELD OF THE INVENTION

This invention relates to exercise and medical devices for stretching muscles, and more particularly to a device for stretching the back and leg muscles.

BACKGROUND

The hamstring muscle group comprises three muscles: the semitendinosus, the semimembranosus, and the biceps femoris. The hamstring muscle group acts upon both the hip and knee joints. The hamstrings play an important role in walking, running, jumping, and controlling some movement of the trunk of the body.

Many people suffer from tightness of the hamstrings. Tightness of the hamstrings can be caused by genetic factors (some people are naturally born with shorter hamstring muscles), back problems can also cause the sciatic nerve to become compressed which can cause the hamstring muscles to tighten, and lack of stretching before physical activity can also cause tightness in the hamstring muscles. Furthermore, sedentary lifestyles and/or desk jobs that involve sitting for long periods of time can also contribute to tightness in the hamstring muscles.

Tightness in the hamstring muscles can cause decreased physical performance and can make the muscles more susceptible to tearing during physical activities. Furthermore, the tightness in the hamstring muscles can also lead to postural problems and/or back problems by causing the hips and/or the pelvis to rotate to position that can compress nerves and/or put strain on other muscle groups. Pain in the back and knees are also a common result.

Stretching of the back and hamstring muscles can increase flexibility and blood flow to these muscles groups and can help to alleviate pain and/or stiffness caused by tightening of the hamstring muscles.

SUMMARY

An apparatus that facilitates the stretching and exercising of the hamstring and back muscles is provided. The apparatus described herein can be used for stretching to improve flexibility, to warm up muscles before physical activity, and/or for physical rehabilitation. The apparatus includes a set of hand grips and a set of foot plates. A user grasps the hand grips and positions the arches of his or her feet above the foot plates. The apparatus includes a user actuated drive mechanism for moving a set of hand grips along the shaft toward the foot plates. The user maintains a grip of the hand grips as the hand grips move along the shaft toward the foot plates, thereby stretching the hamstring and back muscles of the user.

According to an embodiment, an exercise device for stretching the hamstring and muscles is provided. The device includes a support shaft. a set of foot plates disposed at one end of the support shaft, a set of hand grips slideably disposed on the support shaft and being moveable upward along the shaft away from the foot plates and moveable downward along the shaft toward the foot plates, and a user-actuated drive mechanism comprising a ratchet for moving the hand grips and ratchet downward along the support shaft toward the foot plates when the user-actuated drive mechanism is activated.

According to another embodiment, an exercise device for stretching the hamstring and back muscles is provided. The device includes a support shaft, a set of foot plates disposed at one end of the support shaft, a set of hand grips slideably disposed on the support shaft and being moveable upward along the shaft away from the foot plates and moveable downward along the shaft toward the foot plates, and a user-actuated drive mechanism comprising a motor for moving the hand grips downward along the support shaft toward the foot plates when the user-actuated drive mechanism is activated.

According to yet another embodiment, a method of stretching the hamstring and back muscles using an apparatus that includes a user actuated drive mechanism and a hand grip slideably disposed on a shaft, and a foot rest disposed at one end of the shaft, the user actuated drive mechanism being configured to move the hand grip along the shaft toward the foot rest when the drive mechanism is activated by the user. The method includes positioning the footplate of the device under the arches of the user's feet while maintaining the position of the legs relatively straight, grasping the hand grips of the apparatus, squeezing the hand grip of the apparatus to actuate the drive mechanism, causing the drive mechanism to move the hand grip along the shaft towards the foot plates, thereby stretching the back and hamstring muscles of the user.

Other features and advantages of the present invention should be apparent from the following description which illustrates, by way of example, aspects of the invention.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

The following detailed description is directed to certain specific embodiments of the invention. However, the invention can be embodied in a multitude of different systems and methods. In this description, reference is made to the drawings wherein like parts are designated with like numerals throughout.

Figure 7:
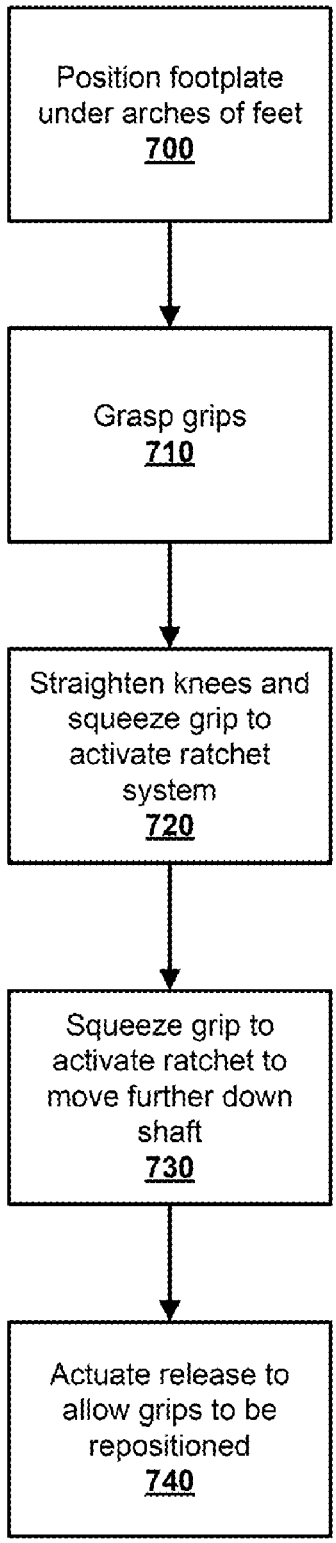
FIG. 7 is flow chart illustrating a method of stretching muscles using the apparatus illustrated in FIGS. 1-6 according to an embodiment.
Figure 8:
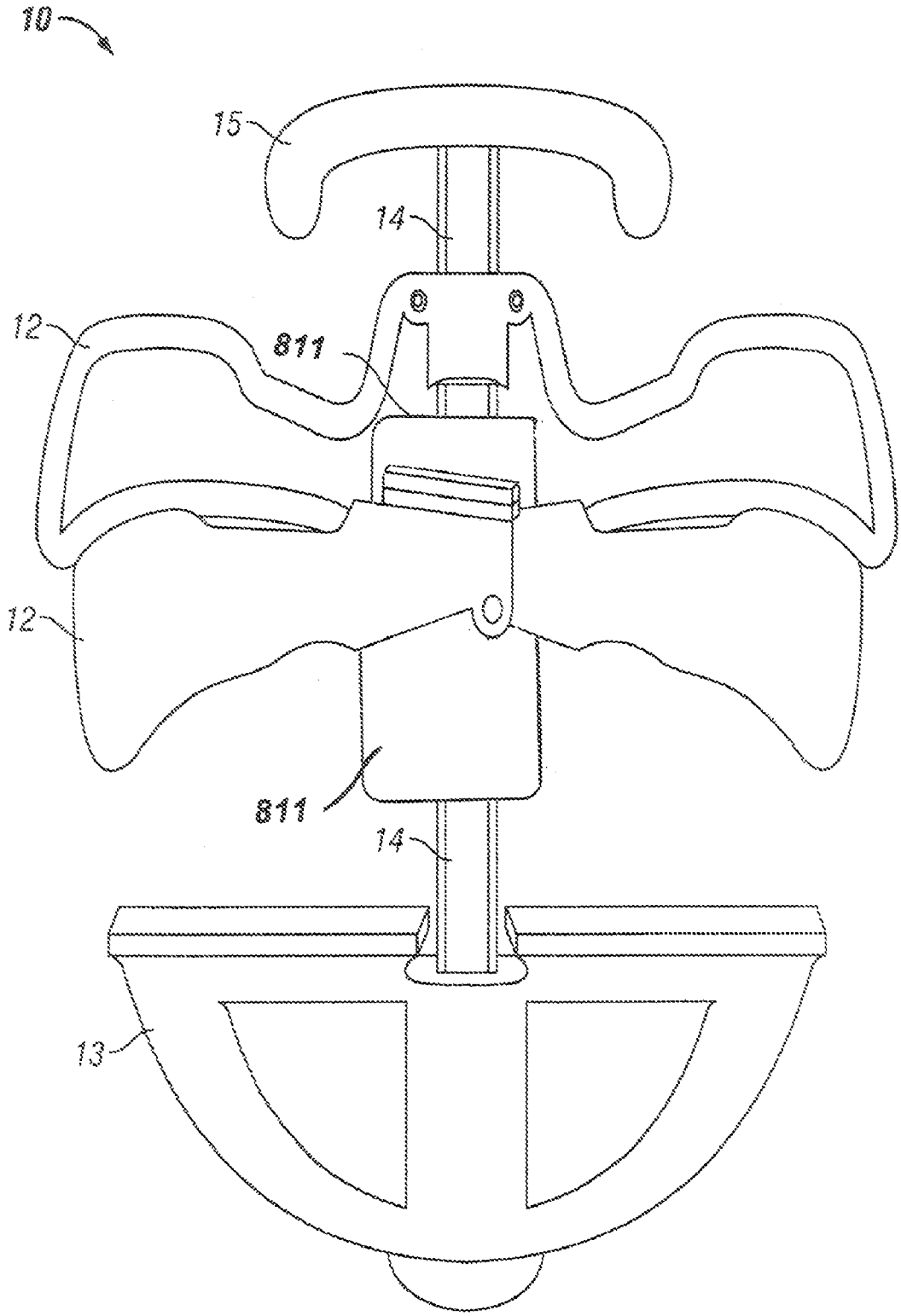
FIG. 8 illustrates an alternative implementation of the apparatus illustrated in FIG. 1 that includes a motor for moving the grip along the shaft of the apparatus according to an embodiment.
Figure 9:
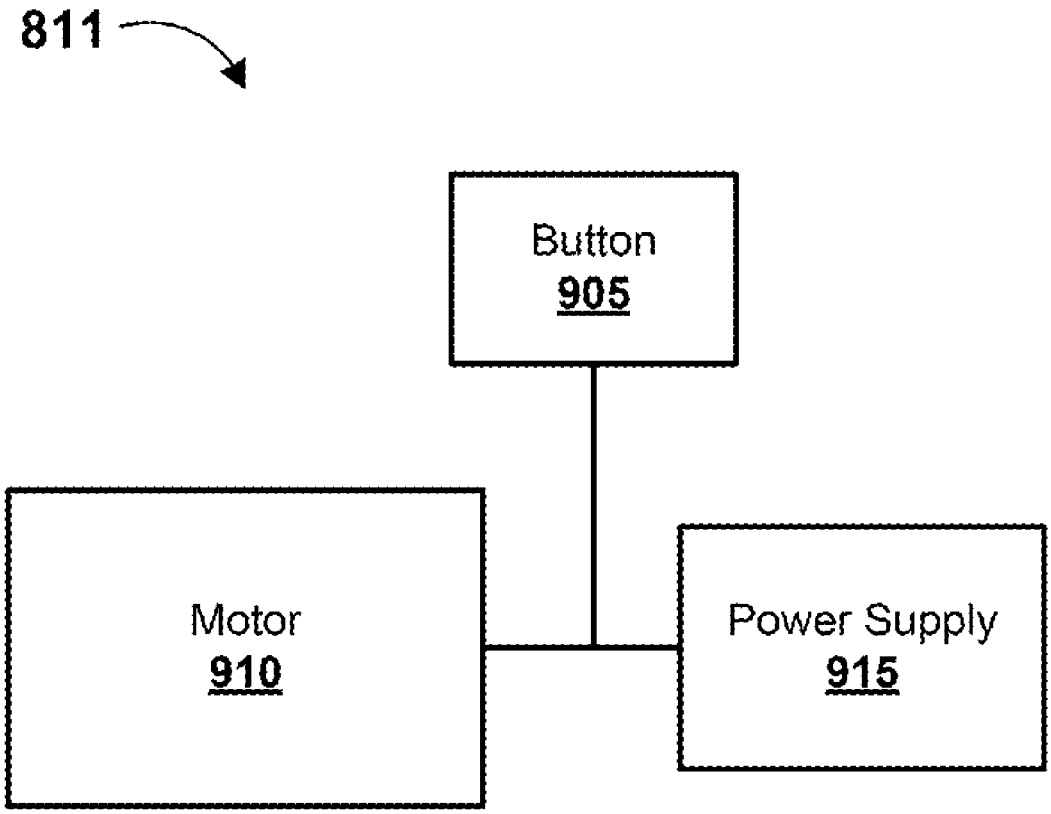
FIG. 9 is a logical block diagram of a motor component that can be used with the apparatus illustrated in FIG. 8 according to an embodiment.
Figure 10:
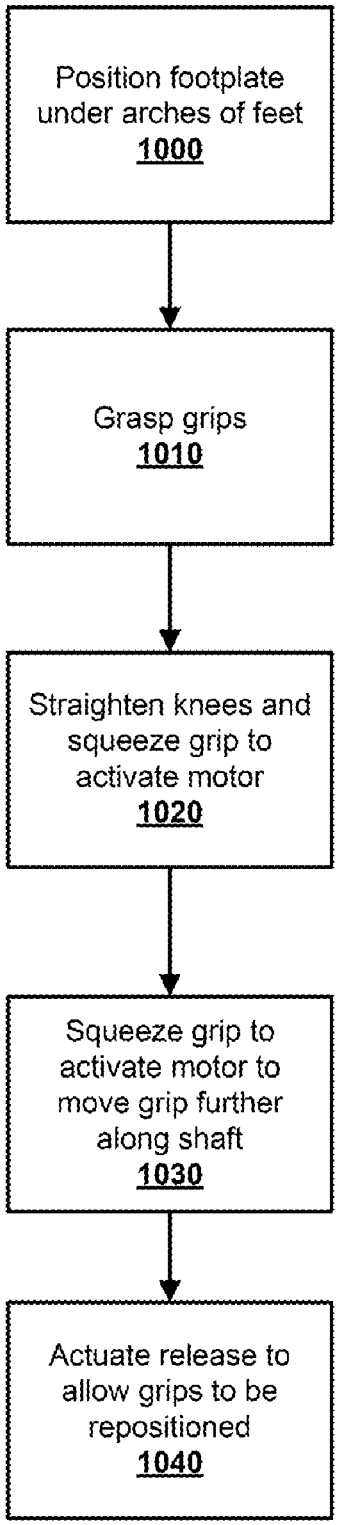
FIG. 10 is a flow chart of a method of stretching the back and hamstring muscles using the apparatus illustrated in FIGS. 8 and 9 according to an embodiment.

FIGS. 1 to 10 of the drawings illustrate embodiments of an exercise/medical apparatus 10. FIGS. 2 to 6 illustrate specific individual components 11, 12, 13, 14, 15 of the apparatus in more detail. FIG. 7 is a flow chart that illustrates a method of stretching the hamstring and back muscles using the apparatus 10. FIG. 9 illustrates an alternative embodiment of the apparatus 10 that includes a motor. FIG. 8 is a block diagram of a motor component that can be used with the embodiment of the apparatus illustrated in FIG. 8. FIG. 10 is a flow chart that illustrates a method for stretching the hamstring and back muscles using the motorized embodiment of apparatus 10 illustrated in FIG. 8. It will be understood that in one embodiment the reverse side of the apparatus 10 is identical in structure and appearance.

Figure 1:
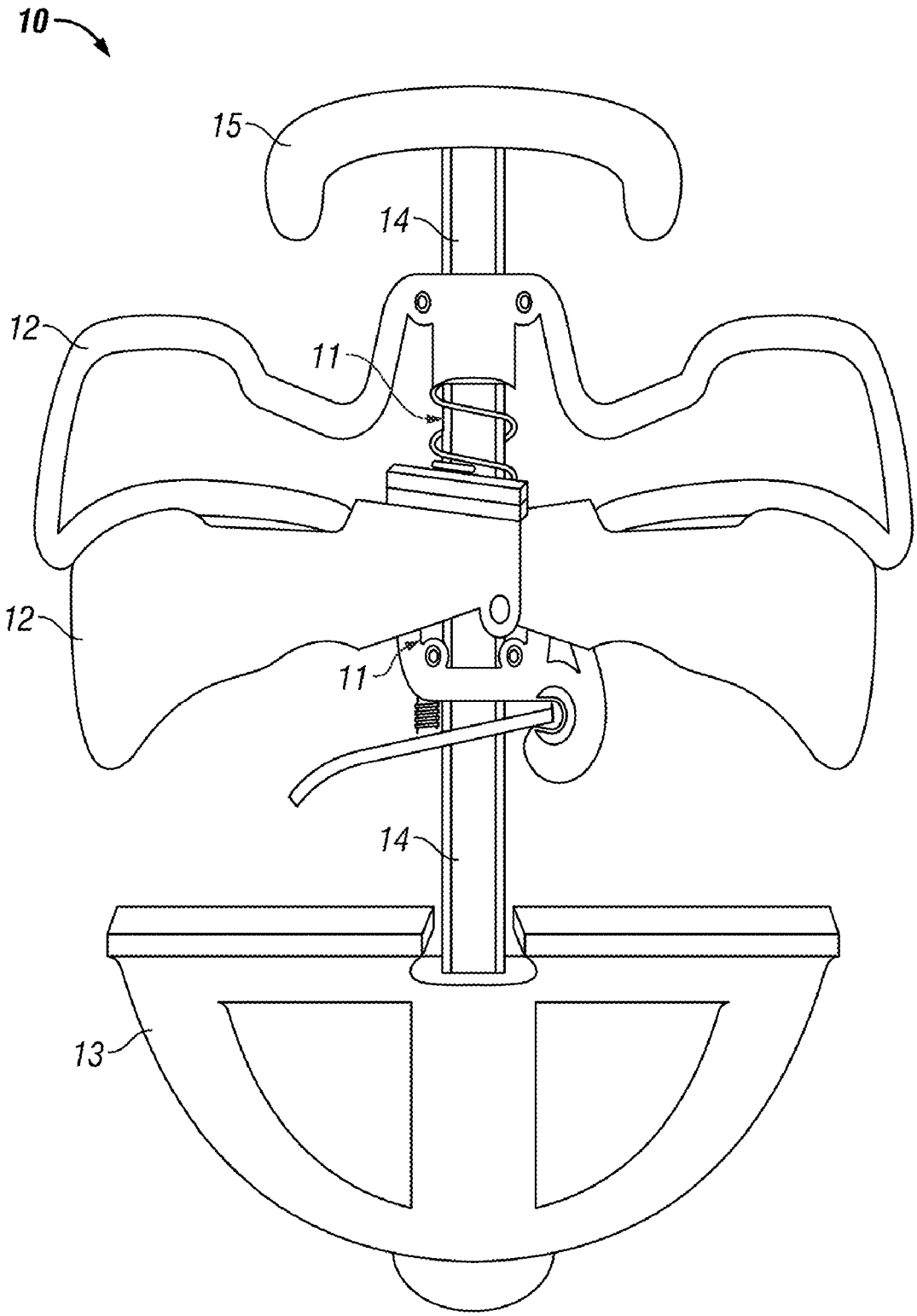
FIG. 1 illustrates an apparatus for stretching the hamstring and back muscles according to an embodiment.

As best illustrated in FIG. 1, the apparatus 10 basically comprises a long center shaft 14. According to an embodiment, the length of the shaft can be in the range of 30 and 40 inches. In other embodiments, the length of the shaft can be selected to fit the size of the user. In one embodiment, the shaft is extendable and retractable in order to change the length of the device for users of different sizes.

The adjoining parts 11, 12, 13, 15 connect to the shaft. Foot plate 13 and handle 15 are stationary and affixed to proximate opposite ends of the main shaft 14 allowing them to perform as end caps, handles, and/or hooks.

Ratchet 11 grip 12 attach to the shaft in a manner allowing for vertical motion up and down the shaft. When all parts are assembled as in FIG. 1, squeezing the grip 12 causes the combination of the ratchet 11 and the grip 12 to travel along the shaft 14 towards the foot rest 13.

Figure 2:
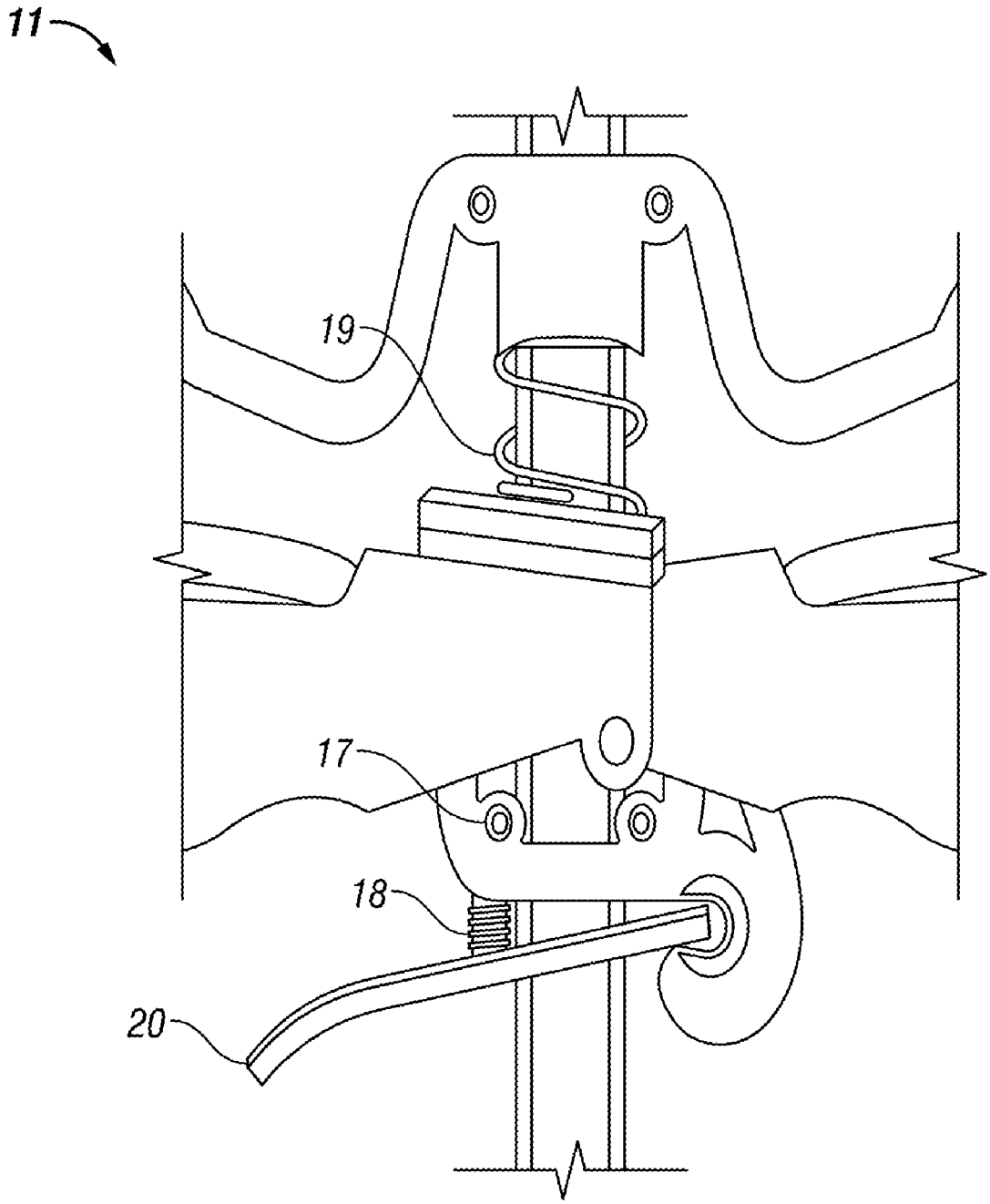
FIG. 2 illustrates a ratchet-like structure that can be used to move the grip along the shaft of the apparatus illustrated in FIG. 1 according to an embodiment.

FIG. 2 details a ratchet-like structure 11 used to move the grip 12 up and down the shaft 14. A large spring 19 is placed between the palm grip 21 and the finger grip 22 portions of the grip 12. This spring is compressed upon squeezing of the palm 21 and finger 22 grips together. This motion actuates the ratchet to moves the grip 12 and ratchet 11 structures downward along the shaft 14. The ratchet 11 moves through the use of springs 18, 19 and metal plates which lock in place due to the angle they are placed against the shaft. Squeezing the grip changes the angle of the metal plates and compresses the main spring 19 allowing the ratchet to creep slightly down the shaft. Upon release of the grip, the metal plates return to the locking angle thereby holding the ratchet in place. In one embodiment, the ratchet is of the type described in U.S. Pat. No. 4,926,722, hereby incorporated by reference. According to an embodiment, the trigger 20 is pulled to release ratchet system allowing the ratchet system to slide up and down the shaft freely. The trigger 20 can be used to position the ratchet 11 and grip 12 back to a starting position along the shaft 14.

Figure 3:
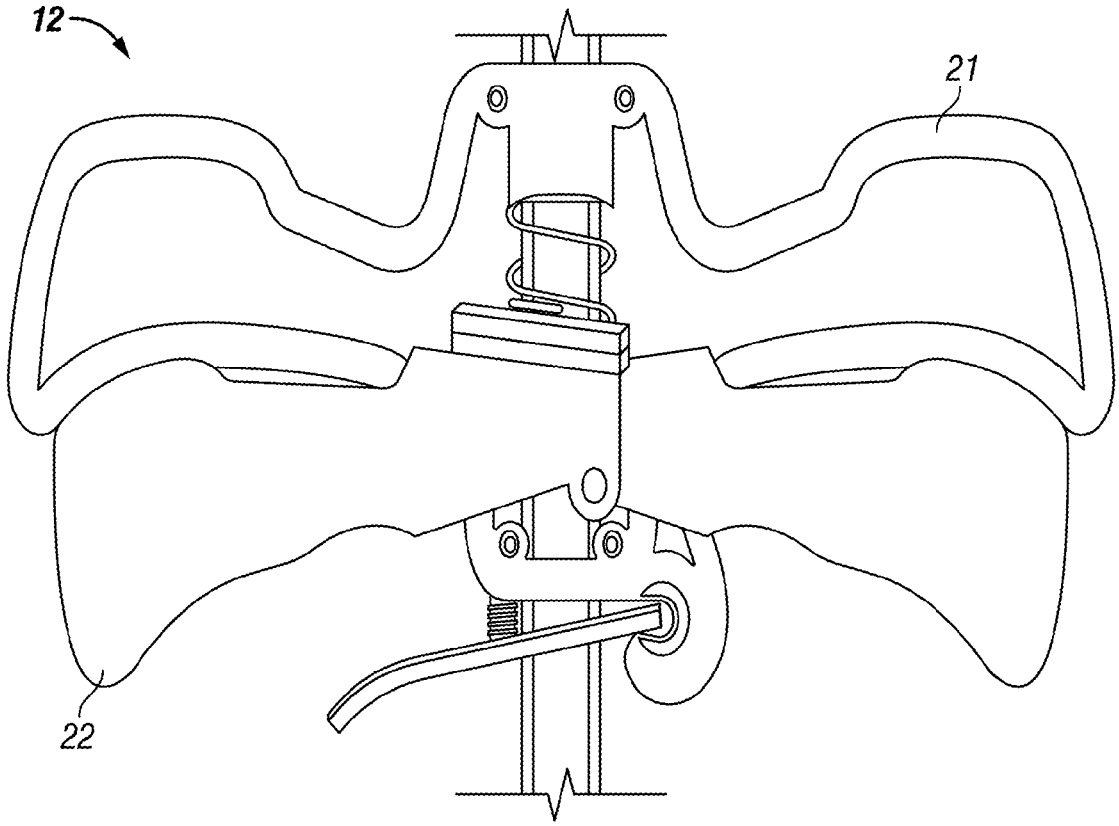
FIG. 3 illustrates the grip and ratchet system of the apparatus illustrated in FIG. 1 according to an embodiment.

FIG. 3 details the grip and ratchet system 11, 12 that moves down the shaft 14. The palm grip 21 is fixed in position relative to the finger grip 22, which is moveable. The finger grip 22 is squeezed toward the palm grip 21 in order to actuate the movement of the grip and ratchet system. The finger grip 22 is hollow and thereby able to pass over the outside of the palm grip 21 as it is being squeezed. Upon release of the finger grip 22, the spring-like part 19 pushes the finger grip 22 back into place.

Alternatively, different types of mechanisms can be used to allow the user to move the grip towards the foot plate. For example, indentations or teeth can be formed in the shaft for use with a ratchet or gear mechanism or the shaft can be threaded to allow for a screw type movement of the grip.

Figure 4:
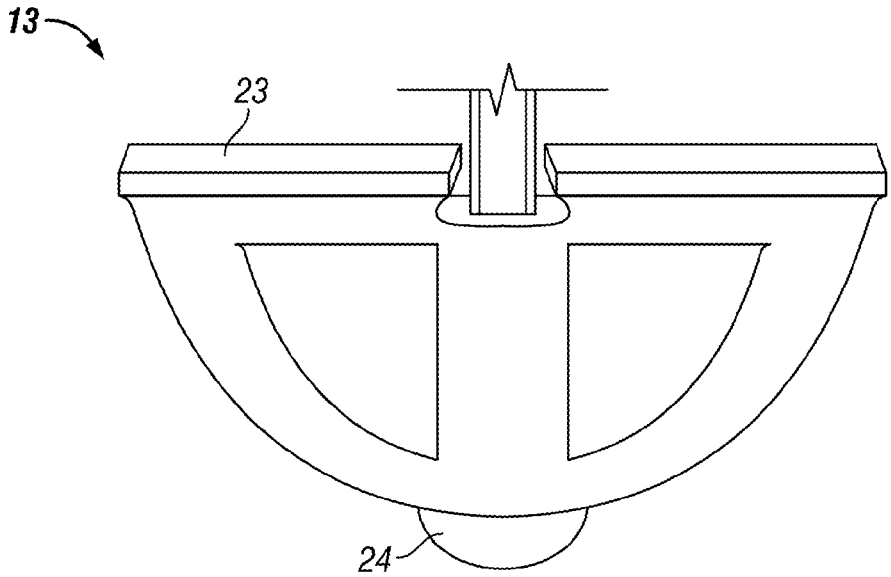
FIG. 4 illustrates the footplate and main plate of the apparatus illustrated in FIG. 1 according to an embodiment.

FIG. 4 details the footplate 13 to be placed under the feet of a user thereby providing the leverage necessary to operate the apparatus. The footplate 13 is secured to the bottom of the shaft 14. In one embodiment the footplate 13 is comprised of two basic sections, the main plate 23 and the bottom end cap 24 to be made of nonslip material. Alternatively, in other embodiments, other shapes and configurations (e.g., straps) can be used to provide allow the user to apply a restraining force against the shaft.

Figure 5:
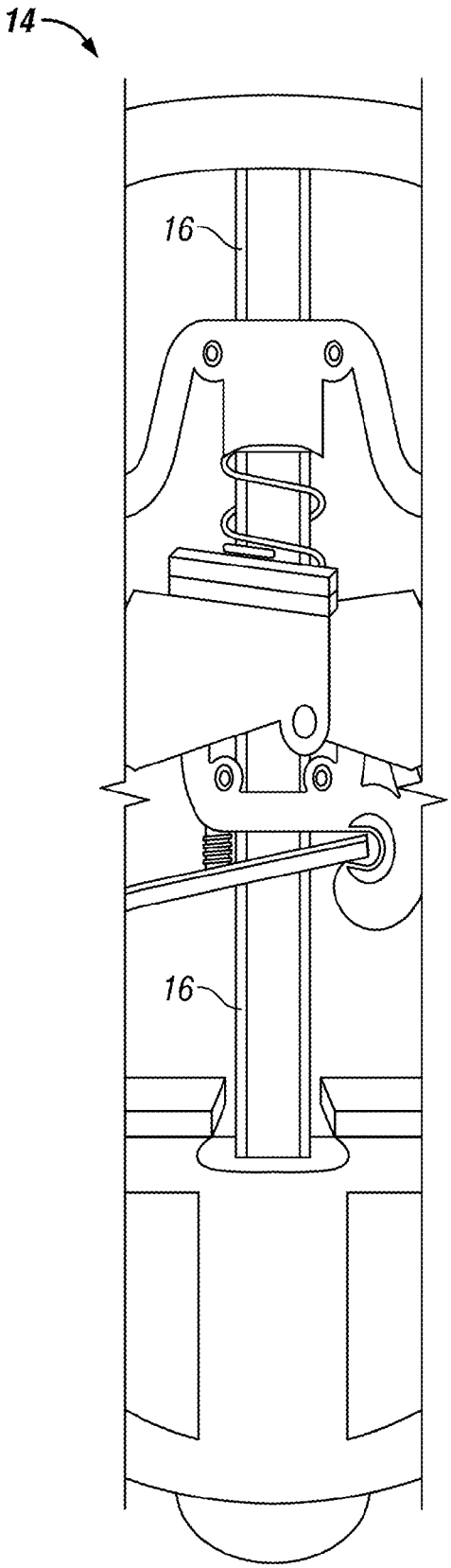
FIG. 5 illustrates the shaft of the apparatus illustrated in FIG. 1 according to an embodiment.
Figure 6:
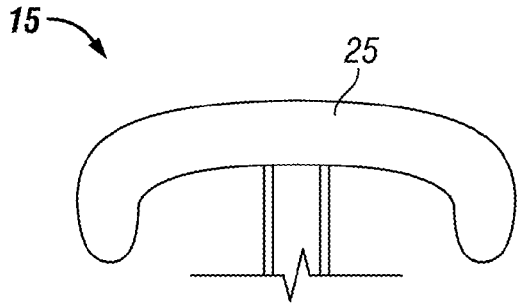
FIG. 6 illustrates the handle and top end cap of the apparatus illustrated in FIG. 1 according to an embodiment.

FIG. 5 details the shaft 14 upon which the apparatus operates. The shaft can be a single or multiple solid structure 16. According to other embodiments, other cross sectional shapes for the shaft can also be used (e.g., circular).

In an embodiment, the shaft 16 is marked with progress lines for the purpose of tracking performance. A performance/progress tracking part (not shown) is attached to the shaft 14 and moves down the shaft 14 when pushed by the grip 11 and ratchet 12 motion. According to an embodiment, the progress tracker can maintain its position along the shaft 14 even after the trigger 20 is used to release the ratchet 11 and grip 12. The progress tracking part can be used to provide feedback to the user regarding how far along the shaft the position of the grips has been FIG. 6 details the handle 15, also referred to as the top end cap 25. The handle 15 is attached to the top of shaft 14. The handle 15 is used for carrying and aesthetic purposes only. The handle 15 is fixed in place and provides no working mechanism or functional purpose during actual use.

FIG. 7 illustrates a method of stretching the muscles of the hamstring and back muscles using the apparatus described above in FIGS. 1-6. To use the device, a person places the footplate under the arches of their feet (step 700). The left hand is placed on one grip and the right hand on the other (step 710). With knees held straight or as close to straight as possible, the person squeezes the grip with one hand (step 720). This squeeze actuates the movement of the ratchet system downward along the shaft. The ratchet system holds it position along the shaft. In an embodiment, the ratchet system holds its position along the shaft with a locking angle which prevents movement up or down the shaft. With each additional squeeze of the grip, the ratchet moves further and further down the shaft towards the footplate creating a stretching effect on the back of the legs including the hamstring muscles and in the muscles of the lower back (step 730). The trigger 20 is pulled to release ratchet system allowing the ratchet system to slide up and down the shaft freely and to return the ratchet 11 and the grip 12 to starting position along the shaft (step 740).

FIG. 8 illustrates an alternative embodiment of the apparatus illustrated in FIG. 1-6 that includes a motor component 811 for moving the grip 12 along the shaft 14. Like the embodiments illustrated in FIGS. 1-6, the motorized embodiment of the apparatus illustrated in FIG. 8 includes a user-actuated drive mechanism. The user-actuated drive mechanism in FIG. 8 uses a motor component 811 to move the grip 12 along the shaft 14 instead of the ratchet mechanism 11 used in the embodiment illustrated in FIG. 1.

The finger grip 22 of the motorized embodiment illustrated in FIG. 8 is squeezed toward the palm grip 21 in order to actuate the motor component 811, causing the movement of the grip 12 and motor component 811 along the shaft 14. According to an embodiment, the motor 811 component and the grip 12 continue to move downward along the shaft while the user continues squeezes the grip 12 and stops when the user releases the grip 12. In some embodiments, the motor is configured to move the grip structure downward along the shaft in a stepwise motion similar to that of the embodiment of FIG. 1 that includes the ratchet 11. For example, in some embodiments, the grip can include a button that is pressed when the grip 12 configured to cause the motor to move one step downward along the shaft each time that the user squeezes the grip with his or her hand.

According to an embodiment, the motor can engage with a gear or set of gears that mesh with the indentations or teeth formed along the shaft in order to move the motor component 811 and the grip 12 along the shaft 14. Alternatively, the shaft can be threaded to allow for a screw type movement motor component 811 and grip 12 along the shaft 14. According to some embodiments, a release similar to trigger 20 can be included to cause the motor component 811 to move freely along the shaft to allow the grip slide up and down the shaft freely. For example, the release can be configured to cause the motor component to disengage from the indentations, teeth, or threads with which the motor component engages to move the grips 12 and the motor component 811 along the shaft. The release mechanism can be used to allow the user to move the grips back up shaft to "reset" the device for use in another stretching session.

FIG. 9 is a logical block diagram of the motor component 811 according to an embodiment. The motor component includes a motor 910, a button 905, and a power supply 915.

According to an embodiment, the motor 910 can be a direct current (DC) motor or an alternating current (AC) motor depending upon the type of power supply 915 selected.

According to an embodiment, the button 905 is disposed between the power supply 915 and the motor 910. In some embodiments, the button 905 can be integrated into the grip 12 so that when a user squeezes the finger grip 22 the button 905 is depressed to complete the circuit between the power supply 915 and the motor 910. According to some embodiments, the grip 12 can have a button 905 on each side of the finger grips 22 so that if the finger grip 22 on either side of the grip 12 is depressed, the motor 910 is activated.

In an embodiment, power supply 915 can be an internal power source, such as a battery, for powering the motor 910. In some embodiments, the internal power source comprises a rechargeable battery pack that placed in a battery compartment of the apparatus 10 (not shown). In some embodiments, the rechargeable battery pack can be charged while installed in the battery compartment of the apparatus 10 by coupling a power cord to the to the apparatus 10 that provides power to the battery pack from an external power source, such as the electrical mains used to provide power to many homes and businesses. According an alternative embodiment, the battery pack may be removable for replacement and/or to be recharged using an external battery charger. In an alternative embodiment, the apparatus 10 can be connected to an external power supply to provide power to the motor 910 via power cord coupled to the motor component 811.

FIG. 10 illustrates a method of stretching the muscles of the hamstring and back muscles using the motorized version of the apparatus described above. To use the device a person places the footplate under the arches of their feet (step 1000). The left hand is placed on one grip and the right hand on the other (step 1010). With knees held straight or as close to straight as possible, the person squeezes the grip with one hand (step 1020). Squeezing the grip causes a button in the grip be depressed, completing a circuit to activate the motor, and the motor moves the grip downward along the shaft. With each additional squeeze of the grip, the motor moves further and further down the shaft towards the person's feet creating a stretching effect on the back of the legs and lower back (step 1030). In some alternative embodiments, motor component is configured to move downward along the shaft as long as the user continues to squeeze the finger grip 22, and releasing the finger grip causes the motor to stop. As described above, some embodiments of the motorized version of the device can include a release similar to trigger 20 that can be used to cause the motor to move freely along the shaft to allow the grip slide up and down the shaft freely. The release mechanism can be used to allow the user to move the grips 12 back up shaft to "reset" the device for use in another stretching session. When the release is actuated, the grip can slide up and down the shaft freely (step 1040). According to alternative embodiments, the grip may include a switch or button that, when activated, causes the motor to move the grip assembly to back up the shaft rather than using a release mechanism to disengage the motor from the shaft.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly not limited.

What is claimed is:

1. An exercise device for stretching the hamstring and back muscles, the device comprising:

a support shaft;

a set of foot plates disposed at one end of the support shaft;

a set of hand grips slideably disposed on the support shaft and being moveable upward along the shaft away from the foot plates and moveable downward along the shaft toward the foot plates;

a user-actuated drive mechanism comprising a ratchet for moving the hand grips and ratchet downward along the support shaft toward the foot plates when the user-actuated drive mechanism is activated.

2. The device of claim 1, wherein the hand grips each comprise a palm grip and a finger grip, and wherein squeezing the finger grips toward the palm grips actuates the ratchet causing the ratchet and hand grips to move downward along the shaft.

3. The device of claim 2, wherein each hand grip include a spring-like component that pushes the finger grip back into position upon release of the finger grip by the user.

4. The device of claim 2, wherein a spring is placed between the palm grip and the finger grip of the hand grips, wherein squeezing the finger grips toward the palm grips causes the spring to be compressed, and wherein the compression of the spring actuates the ratchet to move the hand grips and ratchet downward along the support shaft.

5. The device of claim 1 further comprising:

a release for temporarily disengaging the drive mechanism from the shaft to allow the hand grips to slide freely along the shaft to a starting position.

6. An exercise device for stretching the hamstring and back muscles, the device comprising:

a support shaft;

a set of foot plates disposed at one end of the support shaft;

a set of hand grips slideably disposed on the support shaft and being moveable upward along the shaft away from the foot plates and moveable downward along the shaft toward the foot plates;

a user-actuated drive mechanism comprising a motor for moving the hand grips downward along the support shaft toward the foot plates when the user-actuated drive mechanism is activated.

7. The exercise device of claim 6 wherein the hand grips each comprise a palm grip and a finger grip, and wherein squeezing the finger grips actuates the motor causing the hand grips to move downward along the shaft.

8. The exercise device of claim 7, wherein each hand grip include a spring-like component that pushes the finger grip back into position upon release of the finger grip by the user.

9. The device of claim 6 further comprising:

a release for temporarily disengaging the drive mechanism from the shaft to allow the hand grips to slide freely along the shaft to a starting position.

10. A method of stretching the hamstring and back muscles using an apparatus that includes a user actuated drive mechanism and a hand grip slideably disposed on a shaft, and a foot rest disposed at one end of the shaft, the user actuated drive mechanism being configured to move the hand grip along the shaft toward the foot rest when the drive mechanism is activated by the user, the method comprising:

positioning the footplate of the device under the arches of the user's feet while maintaining the position of the legs relatively straight;

grasping the hand grips of the apparatus;

squeezing the hand grip of the apparatus to actuate the drive mechanism, causing the drive mechanism to move the hand grip along the shaft towards the foot plates, thereby stretching the back and hamstring muscles of the user.

11. The method of claim 10, further comprising:

squeezing the hand grip of the apparatus again to actuate the drive mechanism, causing the drive mechanism to move the hand grip further along the shaft towards the foot plate, further stretching the back and hamstring muscles of the user.

12. The method of claim 10, wherein the user actuated drive mechanism includes a ratchet device, and wherein squeezing the hand grip of the apparatus actuates the ratchet drive to move downward along the shaft toward the foot plates.

13. The method of claim 10, wherein the user actuated drive mechanism comprises a motor, and wherein squeezing the hand grip of the apparatus actuates the motor to move the motor and the hand grips downward along the shaft toward the foot plates.

14. The method of claim 10, further comprising:

actuating a release coupled to the drive mechanism to allow the grip to move freely along the shaft; and repositioning the grip to a starting position along the shaft.

* * * * *